US009520260B2

(12) United States Patent
Hesselink et al.

(10) Patent No.: US 9,520,260 B2
(45) Date of Patent: Dec. 13, 2016

(54) PHOTO EMITTER X-RAY SOURCE ARRAY (PEXSA)

(71) Applicant: The Board of Trustees of the Leland Stanford Junior University, Palo Alto, CA (US)

(72) Inventors: Lambertus Hesselink, Atherton, CA (US); R. Fabian W. Pease, Stanford, CA (US); Piero Pianetta, Palo Alto, CA (US); Juan R. Maldonado, Menlo Park, CA (US); Yao-Te Cheng, New Taipei (TW); Jason Ryan, Stanford, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 217 days.

(21) Appl. No.: 14/026,697

(22) Filed: Sep. 13, 2013

(65) Prior Publication Data

US 2014/0079188 A1 Mar. 20, 2014

Related U.S. Application Data

(60) Provisional application No. 61/701,031, filed on Sep. 14, 2012.

(51) Int. Cl.

| | |
|---|---|
| ***H01J 35/06*** | (2006.01) |
| ***H01J 35/14*** | (2006.01) |
| ***H01J 35/02*** | (2006.01) |

(52) U.S. Cl.

CPC ..... *H01J 35/02* (2013.01); *H01J 35/06* (2013.01); *H01J 35/065* (2013.01); *H01J 35/14* (2013.01); *H01J 2235/087* (2013.01)

(58) Field of Classification Search

CPC .... H01J 35/06; H01J 35/065; H01J 2235/087; H01J 35/14

(Continued)

(56) References Cited

U.S. PATENT DOCUMENTS 3,814,996 A * 6/1974 Enstrom et al. ..... 257/10
4,606,061 A * 8/1986 Ramamurti ..... 378/10

(Continued)

OTHER PUBLICATIONS

Javier Alda, "Laser and Gaussian Beam Propagation and Transformation," Encyclopedia of Optical Engineering, 2003, pp. 999-1013.*

*Primary Examiner* — Allen C. Ho
(74) *Attorney, Agent, or Firm* — Lucent Patent Firm

(57) ABSTRACT

A photo-emitter x-ray source is provided that includes a photocathode electron source, a laser light source, where the laser light source illuminates the photocathode electron source to emit electrons, and an X-ray target, where the emitted electrons are focused on the X-ray target, where the X-ray target emits X-rays. The photocathode electron source can include alkali halides (such as CsBr and CsI), semiconductors (such as GaAs, InP), and theses materials modified with rare Earth element (such as Eu) doping, electron beam bombardment, and X-ray irradiation, and has a form factor that includes planar, patterned, or optically patterned. The X-ray target includes a material such as tungsten, copper, rhodium or molybdenum. The laser light source is pulsed or configured by light modulators including acousto-optics, mode-locking, micro-mirror array, and liquid crystals, the photocathode electron source includes a nano-aperture or nano-particle arrays, where the nano-aperture is a C-aperture or a circular aperture.

10 Claims, 3 Drawing Sheets

(58) Field of Classification Search
USPC ..... 378/119, 121, 122, 136–138
See application file for complete search history.

(56) References Cited

U.S. PATENT DOCUMENTS 4,627,088 A * 12/1986 Doucet et al. ..... 378/122
4,916,303 A * 4/1990 Schoenbach ..... H01L 31/02963 250/214.1
5,042,058 A * 8/1991 Rentzepis ..... 378/122
5,349,177 A * 9/1994 Thomas ..... H01J 31/50 250/214 VT
5,369,267 A * 11/1994 Johnson ..... H01J 31/505 250/214 VT
5,428,658 A * 6/1995 Oettinger et al. ..... 378/136
5,768,337 A * 6/1998 Anderson ..... 378/136
6,195,411 B1 * 2/2001 Dinsmore ..... 378/65
6,319,188 B1 * 11/2001 Lovoi ..... 600/3
6,324,257 B1 * 11/2001 Halavee ..... 378/121
6,333,966 B1 * 12/2001 Schoen ..... 378/119
6,438,206 B1 * 8/2002 Shinar et al. ..... 378/123
6,463,124 B1 * 10/2002 Weisman et al. ..... 378/136
6,480,568 B1 * 11/2002 Dinsmore ..... 378/65
6,493,419 B1 * 12/2002 Dinsmore ..... 378/65
6,516,048 B2 * 2/2003 Mori ..... 378/119
6,538,977 B1 * 3/2003 Yanagisawa ..... G11B 7/08 359/813
6,794,671 B2 * 9/2004 Nicoli ..... G01N 15/0227 250/222.2
6,882,703 B2 * 4/2005 Price et al. ..... 378/91
6,920,202 B1 * 7/2005 Dinsmore ..... 378/119
7,067,819 B2 * 6/2006 Janik ..... G01J 3/10 250/252.1
7,085,350 B2 * 8/2006 Dunham et al. ..... 378/122
7,085,352 B2 * 8/2006 Dunham ..... 378/122
7,136,455 B2 * 11/2006 Dunham et al. ..... 378/119
7,161,162 B2 * 1/2007 Maldonado et al. .... 250/492.24
7,187,755 B2 * 3/2007 Dunham et al. ..... 378/119
7,295,653 B2 * 11/2007 Loewen ..... G02B 5/10 378/119
7,412,033 B2 * 8/2008 Freudenberger et al. .... 378/136
7,496,179 B2 * 2/2009 Freudenberger et al. .... 378/122
7,508,917 B2 * 3/2009 Dittrich et al. ..... 378/136
7,526,068 B2 * 4/2009 Dinsmore ..... 378/137
7,634,047 B2 * 12/2009 Popescu et al. ..... 378/19
7,738,632 B2 * 6/2010 Popescu et al. ..... 378/136
7,816,853 B2 * 10/2010 Freudenberger et al. .... 313/495
7,864,924 B2 * 1/2011 Ziskin et al. ..... 378/136
8,009,350 B2 * 8/2011 Kim ..... G02F 1/353 359/328
8,503,614 B2 * 8/2013 Legagneux et al. ..... 378/122
8,571,181 B2 * 10/2013 Charette et al. ..... 378/137
8,582,720 B2 * 11/2013 Morton ..... 378/87
8,837,678 B2 * 9/2014 Turqueti et al. ..... 378/124
8,917,814 B2 * 12/2014 Takai et al. ..... 378/136
9,117,622 B2 * 8/2015 Gendreau ..... H01J 35/065
9,406,488 B2 * 8/2016 Maldonado ..... H01J 40/14
2004/0208285 A1 * 10/2004 Freudenberger et al. .... 378/119
2010/0020936 A1 * 1/2010 Fritzler et al. ..... 378/136

* cited by examiner

PHOTO EMITTER X-RAY SOURCE ARRAY (PEXSA)

CROSS-REFERENCE TO RELATED APPLICATIONS

This application claims priority from U.S. Provisional Patent Application 61/701,031 filed Sep. 14, 2012, which is incorporated herein by reference.

STATEMENT OF GOVERNMENT SPONSORED SUPPORT

This invention was made with Government support under grant (or contract) no. HSGQDC-12-C-00002 awarded by the Department of Homeland Security. The Government has certain rights in this invention.

FIELD OF THE INVENTION

The present invention relates generally to X-ray imaging, X-ray spectroscopy, and industrial inspection. More particularly, the invention relates to a Photo Emitter X-Ray Source Array (PeXSA) for X-ray imaging.

BACKGROUND OF THE INVENTION

The current approach to differential phase contrast (DPC) is to use gratings in front of conventional X-ray sources. The gratings are very difficult to fabricate for energies higher than 50 KeV, and absorb a considerable amount of X-ray radiation, thereby reducing the achievable SNR.

What is needed is a device that includes a patterned source so that the grating is not needed, and that creates a coherent source enabling interferometric, time resolved measurements such as shadowgraph or Schlieren measurements of objects. Time resolved measurements using X-rays are difficult to make with current X-ray sources, as switching high voltages rapidly, on the order of picoseconds, is very difficult.

SUMMARY OF THE INVENTION

To address the needs in the art, a photo-emitter x-ray source is provided that includes a photocathode electron source, a laser light source, where the laser light source illuminates the photocathode electron source to emit electrons, and an X-ray target, where the emitted electrons are focused on the X-ray target, where the X-ray target emits X-rays.

According to one aspect of the invention, the material of the photocathode electron source can include alkali halides (such as CsBr and CsI), semiconductors (such as GaAs, InP), and theses materials modified with rare Earth element (such as Eu) doping, electron beam bombardment, and X-ray irradiation.

In a further aspect of the invention, the photocathode electron source is capable of operating at energies below a bandgap of the photocathode electron source through doped states or color centers created by high energy radiations (UV, X-rays, gamma rays) or high energy particle bombardment (electrons).

According to a further aspect of the invention, the emitted X-rays has energies below 250 Kev.

In one aspect of the invention, the emitted X-rays are focused to a spot size in a range between 20 nm to 5 mm.

In yet another aspect of the invention, the photocathode electron source has a maximum current density of at least 5 $A/cm^2$, where the current density is a function of the input optical power and a cathode pattern area.

According to a further aspect of the invention, the laser light source has a wavelength in a range of 200 nm to 800 nm.

In one aspect of the invention, a beam from the laser light source is pulsed or steered according to light modulators that can include acousto-optics, mode-locking, micro-mirror array, and liquid crystals.

In a further aspect of the invention, the photocathode electron source includes a nano-aperture or nano-particle arrays, where the nano-aperture is a C-aperture or a circular aperture.

According to another aspect of the invention, the X-ray target includes a material such as tungsten, copper, rhodium or molybdenum.

In another aspect of the invention, the photocathode electron source has a form factor that includes planar, patterned, of optically patterned.

DETAILED DESCRIPTION

Figure 1:
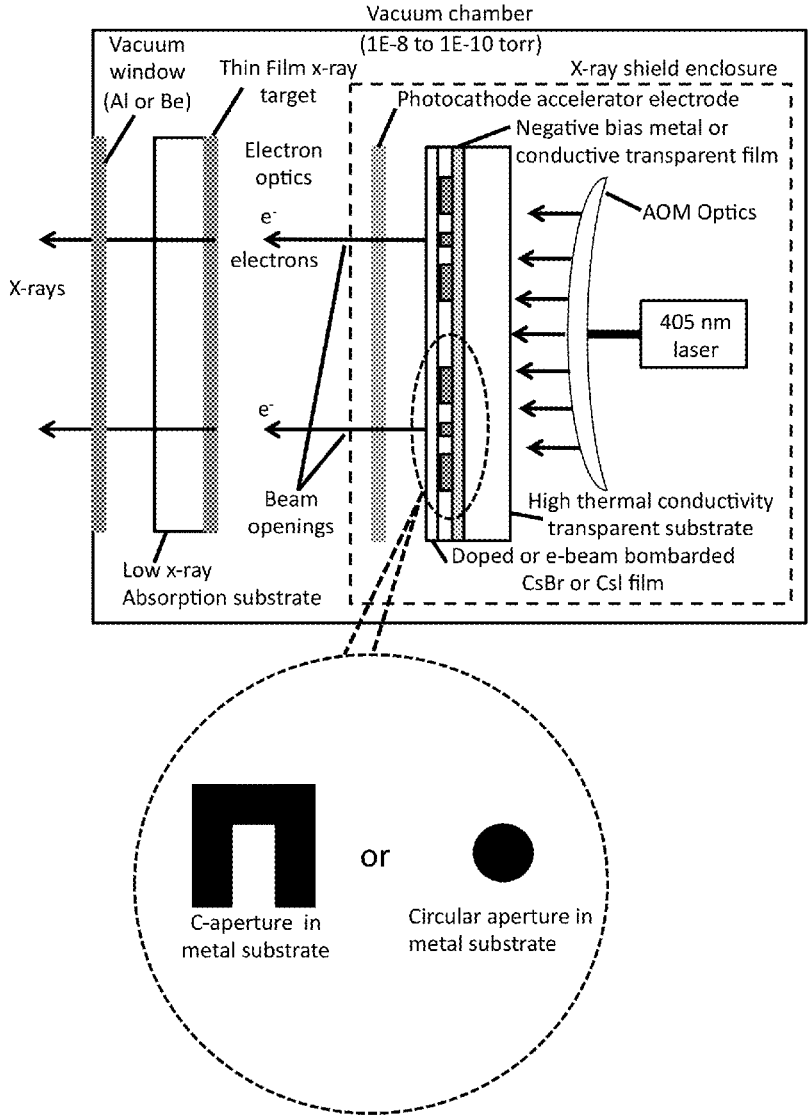
FIG. 1 shows a schematic drawing of the Photo Emitter X-Ray Source Array for X-ray imaging, according to one embodiment of the invention.

The current invention enables new X-ray imaging modalities by creating an X-ray source that can be patterned and modulated at very high rates over time. According to one embodiment, an X-ray target is illuminated by an electron beam, where the electron beam is generated by illuminating a target with a laser source. The laser source can be pulsed to enable very short X-ray pulse trains. This new source enables new imaging modalities such as 3-D differential phase contrast imaging, X-ray point sources with a spatial resolution of less than 20 nm, and X-ray spectroscopic imaging by combining both temporal and spatial imaging modalities.

In one embodiment of the invention, a previously activated material capable of efficient electron emission with a photon energy less than the band gap is illuminated by a laser source, such as a 257 nm doubled Ar laser source, or any other suitable source having a wavelength in a range of 200-800 nm. A pre-sensitized medium emits an electron beam upon illumination by the laser source. A magnetic field is used to image the electron beam onto an X-ray target, or it can be used as an optically induced electron beam in its own right, having a spot size from 20 nm to 5 millimeters, and with very high electron beam intensities. If the electron beam is incident on an X-ray target, such as tungsten, copper, rhodium or molybdenum then an X-ray beam is generated. By patterning the cathode and imaging the cathode onto the target using a magnetic lens, a patterned X-ray beam is generated. By using a preferred 1:1 imaging configuration for the magnetic lens, aberrations are minimized. In a further embodiment, the patterned X-ray source is used to steer the X-ray beam. The patterned source enables partially-coherent X-ray beams to be used in interferometric measurements without the need for an amplitude gratings in front of a standard incoherent X-ray source, as is used in the prior art.

Some exemplary applications of the invention include a differential phase contrast (DPC) imaging, where both the real and imaginary part of a material's index of refraction is measured. This leads to better and more contrast rich images of soft tissue objects or other objects having close to the same X-ray absorption but different real part of the refractive index, such as fluids and home made explosives. Variations in soft tissue such as breast tissue is also better observed with this imaging technique. A further application includes probing matter with a nano-sized, short pulse X-ray beam for spectroscopic imaging with unprecedented spatial resolution, where the pulsed electron beam source, without the X-ray target, can also be used for ionization mass spectroscopy, enabling both time and space dependent measurements.

In a further exemplary application, the photo emitter electron source itself can be used as a far field probe for nano-metrology applications, which cannot be done with a near-field optical probe.

According to the current invention, the combination of short, modulated pulse trains with resolutions from nanometers to macro-scales is unprecedented.

The PeXSA source according the current invention overcomes these problems of using gratings in front of conventional X-ray sources by patterning the source so that the grating is not needed. Another advantage of the PeXSA source is the ability to create a coherent source enabling interferometric, time resolved measurements such as shadowgraph or Schlieren measurements of objects. Time resolved measurements using X-rays are difficult to make with existing X-ray sources, as switching high voltages rapidly, on the order of picoseconds, is very difficult.

According to further embodiments of the invention, different non-linear source materials can be used, such as a previously activated material capable of efficient electron emission with a photon energy less than the band gap of CsBr, either undoped or doped with rare earth elements such as Eu, or Er, or others having atomic weights from 21 to 71. Instead of patterning the cathode the anode can be patterned as well. A laser emitting radiation at 405 nm, for example, may be used with CsBr doped with Eu or other rare earth elements, or pretreated with electron beam bombardment or X-ray irradiation.

According to different embodiments of the invention, the photocathode material can include any one or any combination of alkali halides (such as CsBr and CsI), semiconductors (such as GaAs, InP), and theses materials modified with rare Earth element (such as Eu) doping, electron beam bombardment, or X-ray irradiation.

The invention includes new aspects such as a patterned cathode X-ray source, illuminated by a laser beam, a pulsed X-ray PeXSA having the ability to produce pulses from sub-picosecond to DC, a sub-20 nm X-ray source operating from sub-picosecond to DC, and a patterned source for use in lithography.

The current invention provides differential phase contrast imaging of baggage for DHS applications and other industrial inspection applications. DPC imaging for medical applications, X-ray spectroscopy with nano-sized spatial resolution, potential X-ray beam steering, coherent X-ray imaging and metrology.

Turning now to the figures, FIG. 1 shows a schematic drawing of a photo-emitter X-ray source array (PeXSA), according to one embodiment of the invention. In one aspect, the PeXSA can be used for inspection (X-ray scanning security applications) and medical imaging applications. As shown in this exemplary embodiment, the laser light source is optically pumped by a 405 nm solid state laser, incident on CsBr or CsI suitably doped with a rare earth element or modified with electron beam bombardment to allow operation at energies below the bandgap. In this embodiment, the electrons emanating from the CsBr or CsI film are focused onto an X-ray target to produce X-rays operating at energy levels below 250 KeV, having a potential spot size from 20 nm to 5 mm and power levels maximum cathode current densities of at least 5 $A/cm^2$.

In one embodiment, an array of integrated sources can be implemented. Scaling laws governing larger arrays of hundreds of X-ray sources will be determined.

According to the current invention, the laser light source for the x-ray system could be either a single photoemitter or an array of identical photoemitters controlled by independent laser beams with acousto-optics (AOM), mode-locking, micro-mirror array, liquid crystals or any other suitable light modulators. The current invention allows rapid x-ray gating at frequencies 100's of MHz. The laser wavelength of a preferred embodiment for excitation of electrons in the photocathode materials is chosen to be around 405 nm to enable use of low cost commercially available, high-powered (100's of mW) diode lasers. It is understood that the current invention uses excitation wavelengths in a range of 200 nm to 800 nm. The photo-emitter structure mated to the illuminating laser depends on the required x-ray source spot size and power.

The source x-ray power is limited by heat dissipation in the target, which depends on the required resolution (spot size). According to the current invention, the maximum power that can be handled by the target is approximately given by the relationship: 0.8 W times the spot size in microns. The x-ray spot size produced by solid metal targets depends on the target density and the energy of the bombarding electrons. From the laser light source point of view, for electron spot sizes less than the exciting light wavelength, the C aperture approach is advantageous. For spot sizes greater than the light wavelength, it may be possible to use circular apertures on a metal layer deposited on a high thermal conductivity material like diamond.

According to another embodiment of the invention, the photocathode utilizing CsBr or CsI films takes advantage of the color centers generated on alkali halide materials by UV radiation (257 nm). A band of radiation-induced energy states about 3.8 eV below the vacuum energy. This allows photoemission with 4.8 eV laser radiation. According to one aspect, the invention includes doping the CsBr or CsI films during deposition with the proper elements or modifying the CsBr or CsI films with electron bombardment after deposition, one embodiment uses rare earth materials doping or electron beam bombardment, to induce energy states closer to the vacuum level and allow operation at longer wavelengths (~405 nm).

Doping of CsBr or CsI with materials like Europium generates light emission bands in the visible range suitable for x-ray plate detector applications.

Several types of x-ray targets can be implemented for small spot size applications, according to embodiments of the current invention. One embodiment includes thin metal pads with the desired spot size dimensions and the required x-ray emission characteristics incorporated thereto. The pads are deposited on solid targets made of low atomic number materials like Berylium, which allow low x-ray emission in the range of interest. In a further embodiment, the targets can be made movable so new areas can be utilized as needed. Another embodiment includes the use of transmission targets of the proper metal and thickness. Metal pads can also be deposited on thin Beryllium foils or plates with low x-ray absorption.

As shown in FIG. 1, a thin metal target is deposited on a smooth substrate with low x-ray absorption. The light from the 405 nm laser beams is converted to electrons by the high thermal conductivity transparent substrate, the negative biased metal or conductive transparent film, the nano C-apertures in metal substrate, circular apertures in metal substrate, C-apertures or rectangular and round micro apertures coated on the doped or e-beam bombarded CsBr or CsI film. The electrons generated at the photocathode accelerator electrode are accelerated and focused on the x-ray target with electron optics having electric and magnetic fields. In this exemplary embodiment, the operating vacuum varies between $10^{-8}$ to $10^{-10}$ Torr. The thickness of the Be or Al window depends on the required x-ray spectrum. As shown, an optional x-ray shield enclosure around the photo-emitter source is provided to reduce the CsBr x-ray exposure, which may negatively affect its performance. This can be achieved utilizing a heavy metal cage with appropriate openings.

Figure 2:
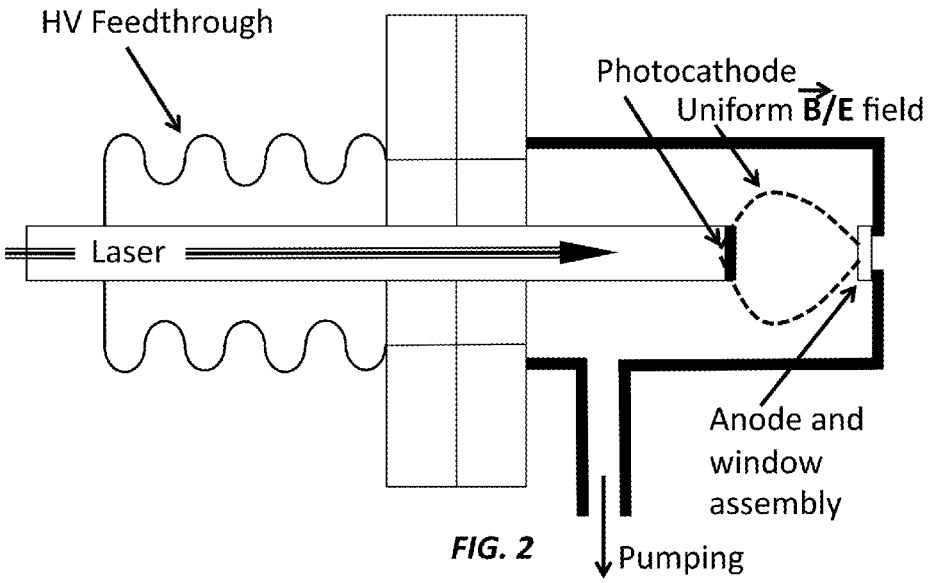
FIG. 2 shows a schematic drawing of a general layout of the Photo Emitter X-Ray Source Array for X-ray imaging having a focusing magnetic field, according to one embodiment of the invention.

According to one example, a uniform B field of 0.11 T and uniform E field of 3.3 MV/m. Focus is achieved after 1 cyclotron orbit at z=30 mm (see FIG. 2).

Figure 3:
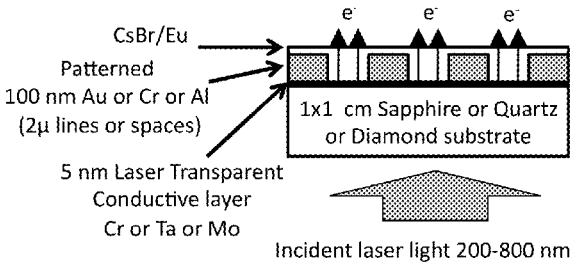
FIG. 3 show a schematic drawing of an exemplary photocathode, according to different embodiments of the invention.

FIG. 3 show a schematic drawing of an exemplary photocathodes, according to different embodiments of the invention. The material of the photocathode electron source can include alkali halides (such as CsBr and CsI), semiconductors (such as GaAs, InP), and theses materials modified with rare Earth element (such as Eu) doping, electron beam bombardment, and X-ray irradiation. Further, the photocathode electron source is capable of operating at energies below a bandgap of the photocathode electron source through doped states or color centers created by high energy radiations (UV, X-rays, gamma rays) or high energy particle bombardment (electrons).

In yet another aspect of the invention, the photocathode electron source has a maximum current density of at least 5 $A/cm^2$, where the current density is a function of the input optical power and a cathode pattern area.

In another aspect of the invention, the photocathode electron source has a form factor that includes planar, patterned, of optically patterned.

One embodiment, to reduce heat loading on the x-ray target, involves illuminating the target with an elliptical electron spot (usually impinging at 6-12 degrees). This can reduce the heat loading by more than a factor of 5. Another embodiment uses a conical target with nucleate boiling to reduce the heat load. This can be accomplished by etching conical indentations on a flat plate and bombarding the inside of the cones with electrons while flowing a high velocity turbulent flow over the back of the cones to enhance heat transfer.

Figure 4:
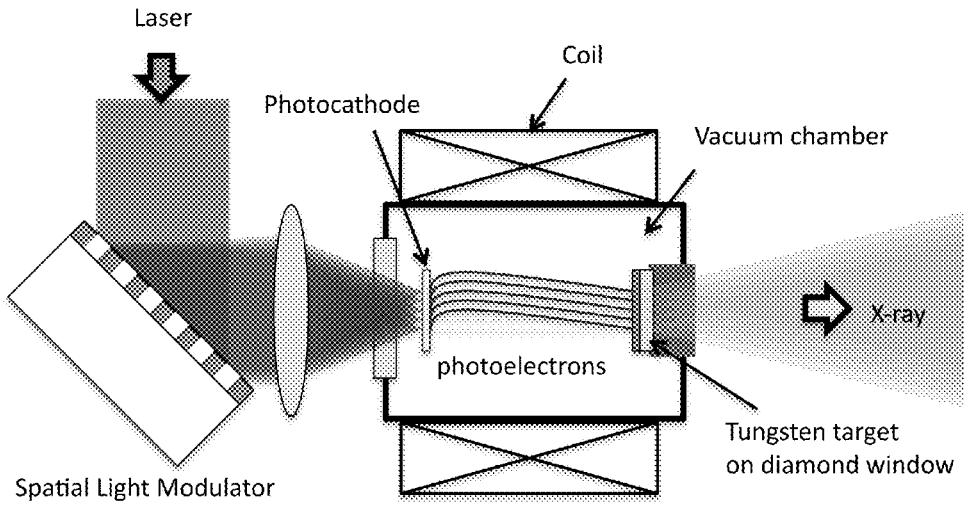
FIG. 4 shows a schematic drawing of an exemplary modifiable PeXSA using a spatial light modulator, according to different embodiments of the invention.

FIG. 4 shows a schematic drawing of an exemplary modifiable PeXSA using a spatial light modulator, according to one embodiment of the invention. Here, the patterned X-ray source can be modifiable if introducing a spatial light modulator to generate the optical pattern on the photocathode. As the optical pattern (hence the X-ray source pattern) can be readily programmed and modified with time by the spatial light modulator, the shape of the X-ray source can be no longer limited by the case of fixed-pattern photocathode, as discussed in FIG. 3. This design can be flexibly repurposed for many applications.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. All such variations are considered to be within the scope and spirit of the present invention as defined by the following claims and their legal equivalents.

What is claimed:

1. A photo-emitter x-ray source, comprising:

a. a photocathode electron source;

b. a laser light source;

c. a beam forming device comprising a spatial light modulator;

d. electron optics; and e. an X-ray target, wherein said laser light source outputs a beam directed to said spatial light modulator, wherein said spatial light modulator forms said beam into an optical spatially patterned beam, wherein said optical spatially patterned beam illuminates said photocathode electron source, wherein said photocathode electron source emits electrons having an electron pattern according to said spatial light modulator, wherein said electron optics comprises an electric field, a magnetic field, or said electric field and said magnetic field disposed to image said electron pattern onto said X-ray target, wherein said X-ray target emits a pattern of X-rays, wherein said pattern of X-rays comprise a patterned partially-coherent X-ray beam.

2. The photo-emitter x-ray source of claim 1, wherein said photocathode electron source comprises a material selected from the group consisting of alkali halides, GaAs, InP, rare Earth element doped alkali halides, rare Earth element doped GaAs, rare Earth element doped InP, alkali halides modified by electron beam bombardment, GaAs modified by electron beam bombardment, InP modified by electron beam bombardment, alkali halides modified by X-ray irradiation, GaAs modified by X-ray irradiation, and InP modified by X-ray irradiation.

3. The photo-emitter x-ray source of claim 1, wherein said photocathode electron source comprises a material capable of operating at energies below a bandgap of said material through doped states or color centers created by UV irradiations, X-rays irradiations, gamma rays irradiations or electron bombardment.

4. The photo-emitter x-ray source of claim 1, wherein said emitted pattern of X-rays comprise energies below 250 KeV.

5. The photo-emitter x-ray source of claim 1, wherein said electron optics are configured to focus the electrons emitted from the photocathode electron source to a spot size in a range between 20 nm to 5 mm.

6. The photo-emitter x-ray source of claim 1, wherein said laser light source emitting a radiation at a wavelength in a range of 200 nm to 800 nm.

7. The photo-emitter x-ray source of claim 1, wherein said beam forming device comprises a nano-aperture disposed directly on said photocathode electron source, wherein said nano-aperture comprises one of nano-particle arrays, a C-aperture, or a circular aperture.

8. The photo-emitter X-ray source of claim 1, wherein said X-ray target comprises a material selected from the group consisting of tungsten, copper, rhodium and molybdenum.

9. The photo-emitter X-ray source of claim 1, wherein said photocathode electron source comprises a form factor selected from the group consisting of planar, patterned, and optically patterned.

10. The photo-emitter X-ray source of claim 1, wherein said laser light source is temporally modulated.

* * * * *